US009726202B2

(12) United States Patent
Tsutsui et al.

(10) Patent No.: US 9,726,202 B2
(45) Date of Patent: Aug. 8, 2017

(54) PUMP DEVICE AND HYDRAULIC ACTUATOR

(71) Applicant: Showa Corporation, Gyoda-shi (JP)

(72) Inventors: Hayato Tsutsui, Haga-gun (JP); Takeshi Ueki, Haga-gun (JP); Shinya Horie, Haga-gun (JP); Kazuhiko Sadakata, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 344 days.

(21) Appl. No.: 14/517,389

(22) Filed: Oct. 17, 2014

(65) Prior Publication Data

US 2015/0275930 A1 Oct. 1, 2015

(30) Foreign Application Priority Data

Mar. 25, 2014 (JP) ..... 2014-062717

(51) Int. Cl.

| | |
|---|---|
| ***F15B 11/02*** | (2006.01) |
| ***F15B 11/028*** | (2006.01) |
| ***F04B 19/00*** | (2006.01) |
| ***F04B 49/22*** | (2006.01) |
| ***F04B 53/10*** | (2006.01) |
| ***F15B 15/18*** | (2006.01) |

(52) U.S. Cl.

CPC ..... *F15B 11/028* (2013.01); *F04B 19/00* (2013.01); *F04B 49/22* (2013.01); *F04B 53/10* (2013.01); *F04B 53/1095* (2013.01); *F15B 15/18* (2013.01); *F15B 2211/205* (2013.01); *F15B 2211/20561* (2013.01); *F15B 2211/27* (2013.01); *F15B 2211/30* (2013.01); *F15B 2211/3051* (2013.01); *F15B 2211/50518* (2013.01); *F15B 2211/511* (2013.01); *F15B 2211/56* (2013.01); *F15B 2211/7053* (2013.01)

(58) Field of Classification Search

CPC ..... F15B 11/028
USPC ..... 60/473, 476
See application file for complete search history.

(56) References Cited

U.S. PATENT DOCUMENTS

| | | | | |
|---|---|---|---|---|
| 7,254,945 | B1 * | 8/2007 | Sakai | F15B 7/006 60/476 |
| 7,641,290 | B2 * | 1/2010 | Miller | F15B 21/044 180/441 |
| 8,161,742 | B2 * | 4/2012 | Sweeney | F04B 35/045 60/476 |

FOREIGN PATENT DOCUMENTS

| | | |
|---|---|---|
| JP | 11-082411 A | 3/1999 |

* cited by examiner

*Primary Examiner* — Thomas E Lazo
(74) *Attorney, Agent, or Firm* — Leason Ellis LLP

(57) ABSTRACT

Provided is a pump device and a hydraulic actuator that can reduce the number of steps of performance measurement. The pump device includes: a switching valve for switching a flow of oil to a first chamber or a second chamber of a cylinder device, the inside of which is segmented into the first chamber and the second chamber by a piston; an up blow valve (first chamber-side relief valve) that relieves pressure of a first chamber-side flow path connected to the first chamber; and a down blow valve (second chamber-side relief valve) that relieves pressure of a second chamber-side flow path connected to the second chamber.

8 Claims, 11 Drawing Sheets

PUMP DEVICE AND HYDRAULIC ACTUATOR

CROSS-REFERENCE TO RELATED APPLICATIONS

This application is based on and claims priority under 35 U.S.C. 119 from Japanese Patent Application No. 2014-062717 filed on Mar. 25, 2014, the entire content of which is incorporated herein by reference.

BACKGROUND OF THE INVENTION

1. Field of the Invention

The present invention relates to a pump device and a hydraulic actuator.

2. Description of the Related Art

A hydraulic actuator includes a hydraulic cylinder (cylinder device) that is extended and compressed by the fluid pressure of hydraulic fluid, a pump device that supplies hydraulic fluid, a hydraulic circuit connected to the cylinder device to control the fluid pressure of hydraulic fluid, and a tank that stores hydraulic fluid. Various valves are provided to the hydraulic circuit, and many of the valves are provided with a control block.

A relief valve of the valves in the hydraulic circuit may be integrated with a pump (for example, see Japanese Patent Application Laid-open No. H11-082411).

[Patent Document 1] Japanese Patent Application Laid-open No. H11-082411

SUMMARY OF THE INVENTION

In a production process of a hydraulic actuator, the performance of a pump device alone is measured, and then, when the pump device is assembled to a control block built in with multiple valves such that a hydraulic circuit is connected, the performance of the entire hydraulic circuit including the pump device is measured.

In this manner, a performance measurement for a pump device alone and a performance measurement for a hydraulic circuit need to be performed in separate steps in a hydraulic actuator, and there is a problem of a large number of steps. When the performance measured for the hydraulic circuit does not satisfy the desired performance, there is an additional work in which an assembled body is disassembled for replacement of a valve or the like and reassembled.

The present invention has been made in view of a situation described above, and an object is to provide a pump device and a hydraulic actuator that can reduce the number of steps for a performance measurement.

A pump device of the present invention comprises: a switching valve for switching a flow of hydraulic fluid to one of a first chamber and a second chamber of a cylinder device, an inside of which is segmented into the first chamber and the second chamber by a piston; a first chamber-side relief valve that is capable of relieving pressure of a first chamber-side flow path connected to the first chamber; and a second chamber-side relief valve that is capable of relieving pressure of a second chamber-side flow path connected to the second chamber.

In the pump device of the invention, the first chamber-side relief valve and the second chamber-side relief valve may include a pressure adjustment mechanism that adjusts a working pressure.

In the pump device of the invention, the first chamber-side relief valve may be provided in a flow path between the switching valve and the first chamber.

The pump device of the invention may be such that the first chamber-side relief valve and the second chamber-side relief valve are provided in a flow path between the switching valve and a pump for feeding the hydraulic fluid, and a third relief valve including a pressure adjustment mechanism that adjusts a working pressure is provided in a flow path between the first chamber and the switching valve.

A hydraulic actuator of the present invention includes a cylinder device, an inside of which is segmented into a first chamber and a second chamber by a piston, and a pump device including: a switching valve for switching a flow of hydraulic fluid to one of the first chamber and the second chamber; a first chamber-side relief valve that is capable of relieving pressure of a first chamber-side flow path connected to the first chamber; and a second chamber-side relief valve that is capable of relieving pressure of a second chamber-side flow path connected to the second chamber.

With the pump device of the present invention, the number of steps for a performance measurement can be reduced.

With the hydraulic actuator of the present invention, the number of steps for a performance measurement can be reduced.

DETAILED DESCRIPTION OF THE INVENTION

Embodiment 1

An embodiment of the present invention will be described below with reference to the accompanying drawings.

Figure 1:
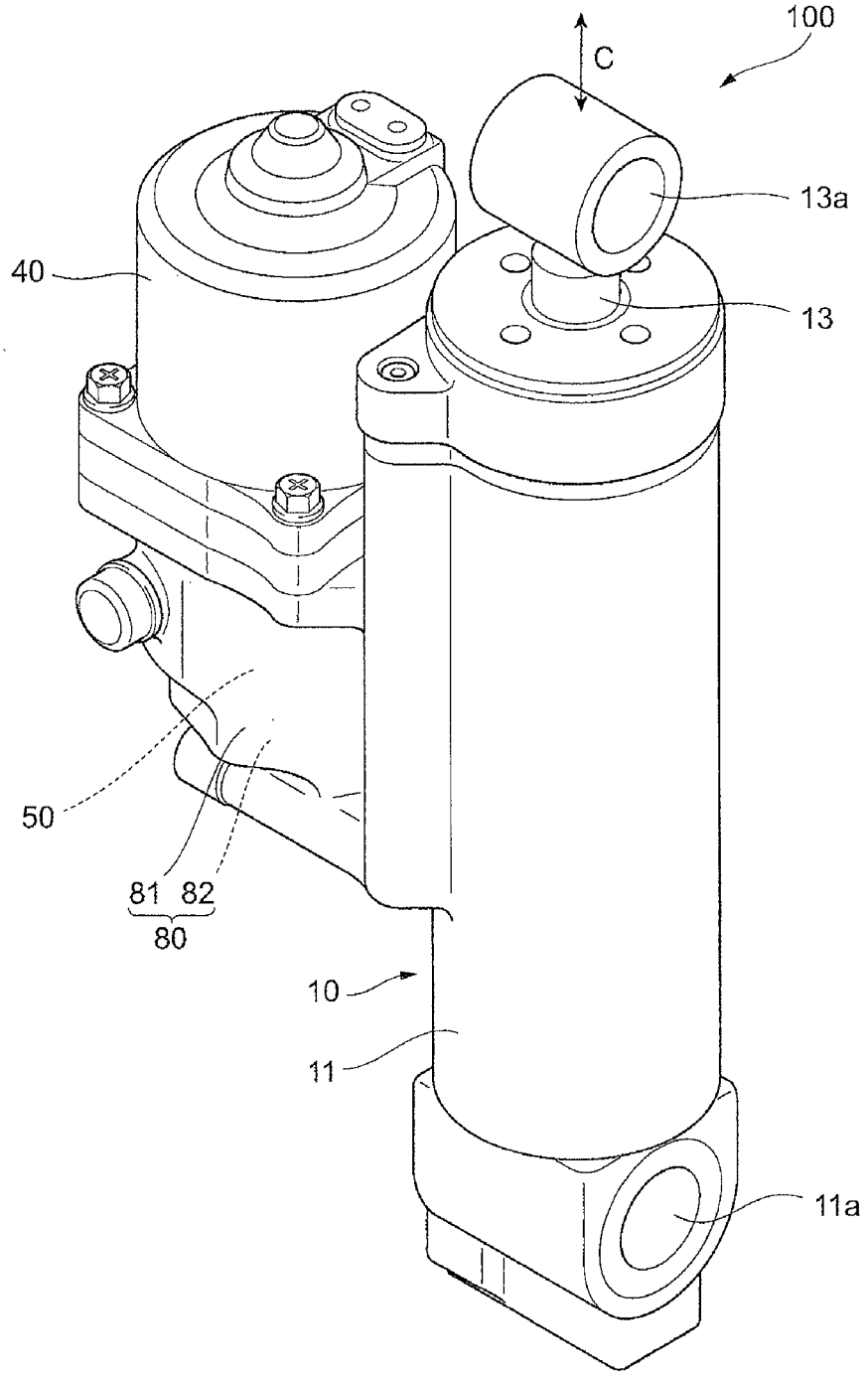
FIG. 1 is a perspective view showing the external appearance of a trim tilt device including a pump device according to one embodiment of the present invention.
Figure 2:
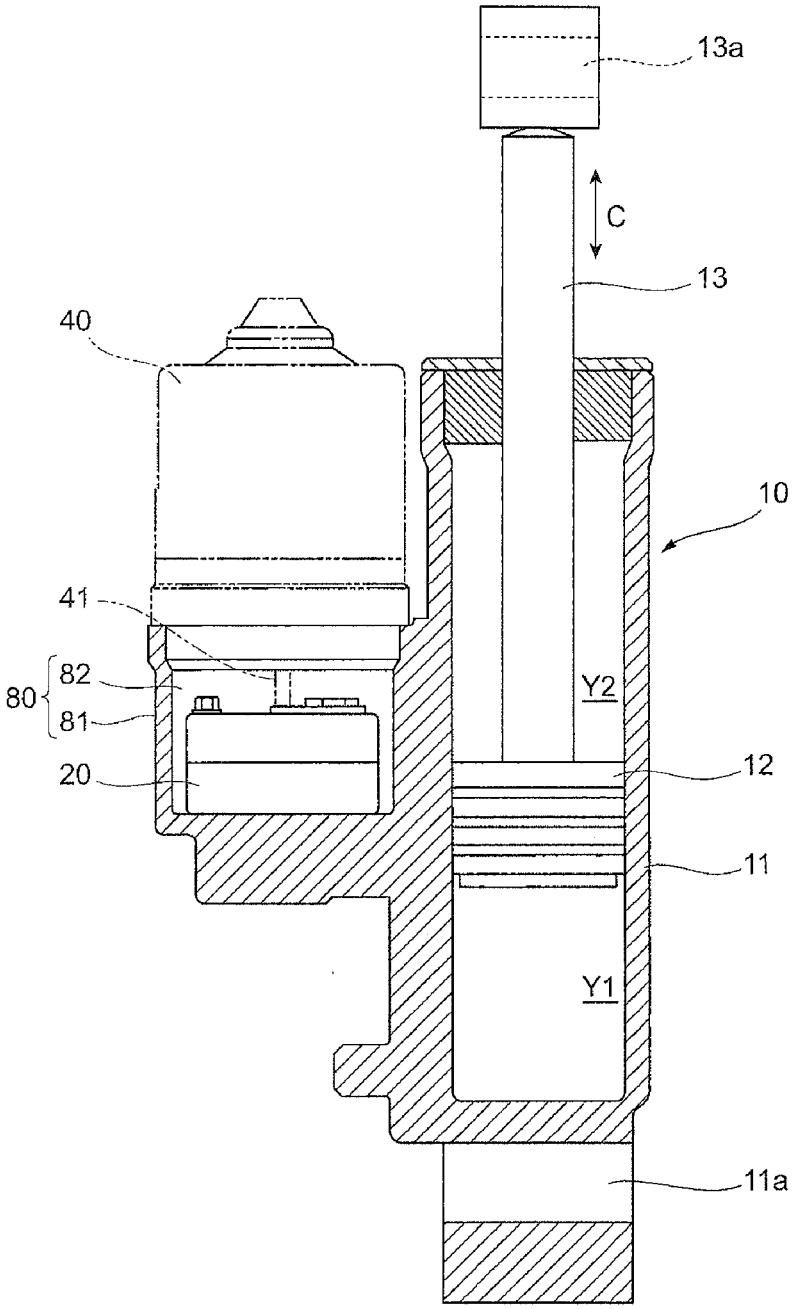
FIG. 2 is a sectional view of a main section of the trim tilt device.
Figure 3:
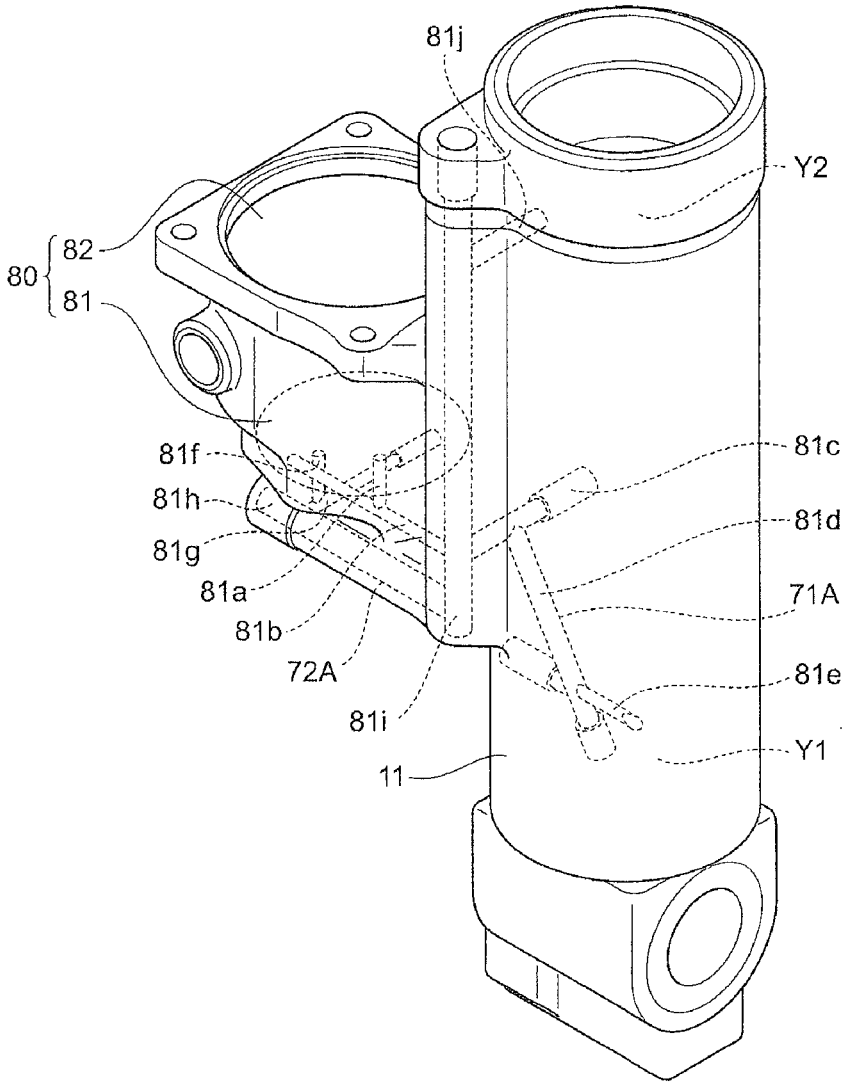
FIG. 3 is a perspective view showing a housing and a cylinder of the trim tilt device.

FIG. 1 is a perspective view showing the external appearance of a trim tilt device 100 (as one example of a hydraulic actuator) including a pump device 20 according to one embodiment of the present invention. FIG. 2 is a sectional view of a main section of the trim tilt device 100. FIG. 3 is a perspective view showing a housing 81 and a cylinder 11 of the trim tilt device 100.

<Schematic Configuration of Trim Tilt Device 100>

As shown in FIGS. 1 and 2, the trim tilt device 100 includes a cylinder device 10 extended and compressed by supply and discharge of oil that is one example of hydraulic fluid, the pump device 20 that feeds oil, a motor 40 that drives the pump device 20, and a tank 80 that stores oil.

(Cylinder Device 10)

As shown in FIG. 2, the cylinder device 10 includes the cylinder 11 extending in an axis C direction, a piston 12 that is arranged inside the cylinder 11 and slides along the axis C direction of the cylinder 11, and a piston rod 13 that is fixed at one end with the piston 12 to be displaced integrally with the piston 12 and that moves forward and backward in the axis C direction with respect to the cylinder 11.

The inside of the cylinder device 10 is segmented by the piston 12 into a first chamber Y1 and a second chamber Y2. The cylinder device 10 extends when oil is supplied to the first chamber Y1, and the cylinder device 10 compresses when oil is supplied to the second chamber Y2. Oil is discharged from the second chamber Y2 when the cylinder device 10 extends, and oil is discharged from the first chamber Y1 when the cylinder device 10 compresses.

At a lower end of the cylinder 11 in the drawing, a pin hole 11*a* to which a pin (not shown) for connection with a stern bracket 340 a ship propelling machine 300 described below (see FIG. 4 described below) is inserted is formed. At an upper end of the piston rod 13 in the drawing, a pin hole 13*a* to which a pin (not shown) for connection with a swivel case 330 of the ship propelling machine 300 (see FIG. 4) is inserted is formed.

(Tank 80)

The tank 80 is configured of the housing 81 and a tank chamber 82 that is a space surrounded by the housing 81. The housing 81 is formed integrally with the cylinder 11. In the housing 81 and the cylinder 11, as shown in FIG. 3, only two oil flow paths connecting the pump device 20 and the first chamber Y1 as well as the second chamber Y2 of the cylinder device 10 are formed in a part of a cylinder-side and first chamber-side flow path 71A and in a part of a cylinder-side and second chamber-side flow path 72A.

A part of the cylinder-side and first chamber-side flow path 71A is formed by connecting a first housing hole 81*a*, a second housing hole 81*b*, a third housing hole 81*c*, a first cylinder hole 81*d*, and a second cylinder hole 81*e*.

The first housing hole 81*a* is formed to extend downward from the bottom surface of the housing 81 so as not to penetrate a bottom section of the housing 81. The second housing hole 81*b* is formed to extend horizontally from the side surface of the bottom section of the housing 81 toward the cylinder 11 so as to intersect with the first housing hole 81*a*. The third housing hole 81*c* is formed to extend horizontally from the side surface of a boundary portion between the housing 81 and the cylinder 11 so as to be orthogonal to the second housing hole 81*b*. The first cylinder hole 81*d* is formed to extend diagonally upward from the side surface of the cylinder 11 so as to intersect with the third housing hole 81*c*. The second cylinder hole 81*e* is formed to extend horizontally from the side surface of the cylinder 11 so as to intersect with the first cylinder hole 81*d* and be open to the first chamber Y1.

The second housing hole 81*b*, the third housing hole 81*c*, the first cylinder hole 81*d*, and the second cylinder hole 81*e* are each closed by a plug or the like (not shown) at a portion facing the outside of the housing 81 and a portion facing the outside of the cylinder 11.

A part of the cylinder-side and second chamber-side flow path 72A is formed by connecting a fourth housing hole 81*f*, a fifth housing hole 81*g*, a sixth housing hole 81*h*, a third cylinder hole 81*i*, and a fourth cylinder hole 81*j*.

The fourth housing hole 81*f* is formed to extend downward from the bottom surface of the housing 81 so as not to penetrate the bottom section of the housing 81. The fifth housing hole 81*g* is formed to extend horizontally from the side surface of the bottom section of the housing 81 so as to intersect with the fourth housing hole 81*f*. The sixth housing hole 81*h* is formed to extend horizontally from the side surface of the bottom section of the housing 81 toward the cylinder 11 so as to be orthogonal to the fifth housing hole 81*g*. The third cylinder hole 81*i* is formed to extend downward from the upper surface of the cylinder 11 so as to be orthogonal to the sixth housing hole 81*h*. The fourth cylinder hole 81*j* is formed to extend diagonally downward from the second chamber Y2 so as to intersect with the third cylinder hole 81*i*.

The fifth housing hole 81*g*, the sixth housing hole 81*h*, and the third cylinder hole 81*i* are each closed by a plug or the like (not shown) at a portion facing the outside of the housing 81 and a portion facing the outside of the cylinder 11.

At a bottom section of the tank chamber 82, the pump device 20 is arranged. Since oil is stored in the tank chamber 82, the pump device 20 is immersed in oil.

(Motor 40)

The motor 40 is placed on the housing 81 close an upper opening of the tank chamber 82 in a liquid-tight manner and is fixed to the housing 81. In this state, a drive shaft 41 (see FIG. 2) of the motor 40 is coupled to a gear pump 21 (a main pump body: see FIG. 7 described below) of the pump device 20 arranged in the tank chamber 82, so that the gear pump 21 can be driven by the motor 40.

The pump device 20 will be described below.

Figure 4:
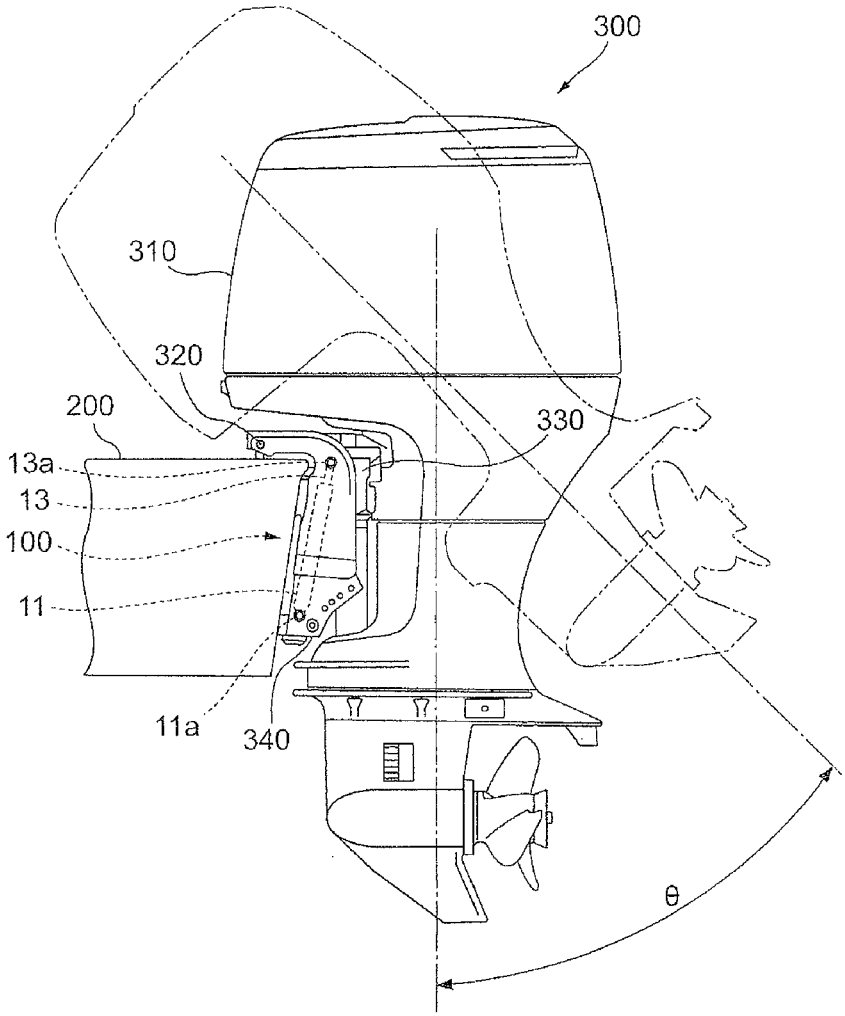
FIG. 4 is a schematic view showing the arrangement of a hull and a ship propelling machine for which the trim tilt device is used, when seen from the side.

FIG. 4 is a schematic view showing the arrangement of a hull 200 and the ship propelling machine 300 for which the trim tilt device 100 is used, when seen from the side.

As shown in FIG. 4, the ship propelling machine 300 includes a ship propelling machine body 310 that generates propulsion. The ship propelling machine body 310 includes a swivel shaft (not shown) provided in a perpendicular direction (vertical direction), a horizontal shaft 320 provided in a horizontal direction with respect to a water surface, the swivel case 330 that accommodates the swivel shaft to be rotatable, and the stern bracket 340 that connects the swivel case 330 to the hull 200.

The stern bracket 340 and the pin hole 11*a* of the cylinder 11 of the trim tilt device 100 are coupled by a pin, and the swivel case 330 and the pin hole 13*a* of the piston rod 13 are coupled by a pin. By the cylinder device 10 extending and compressing, the distance between the stern bracket 340 and the swivel case 330 changes to change an inclination angle θ of the ship propelling machine 300 with respect to the hull 200.

<Hydraulic Circuit of Trim Tilt Device 100>

Figure 5:
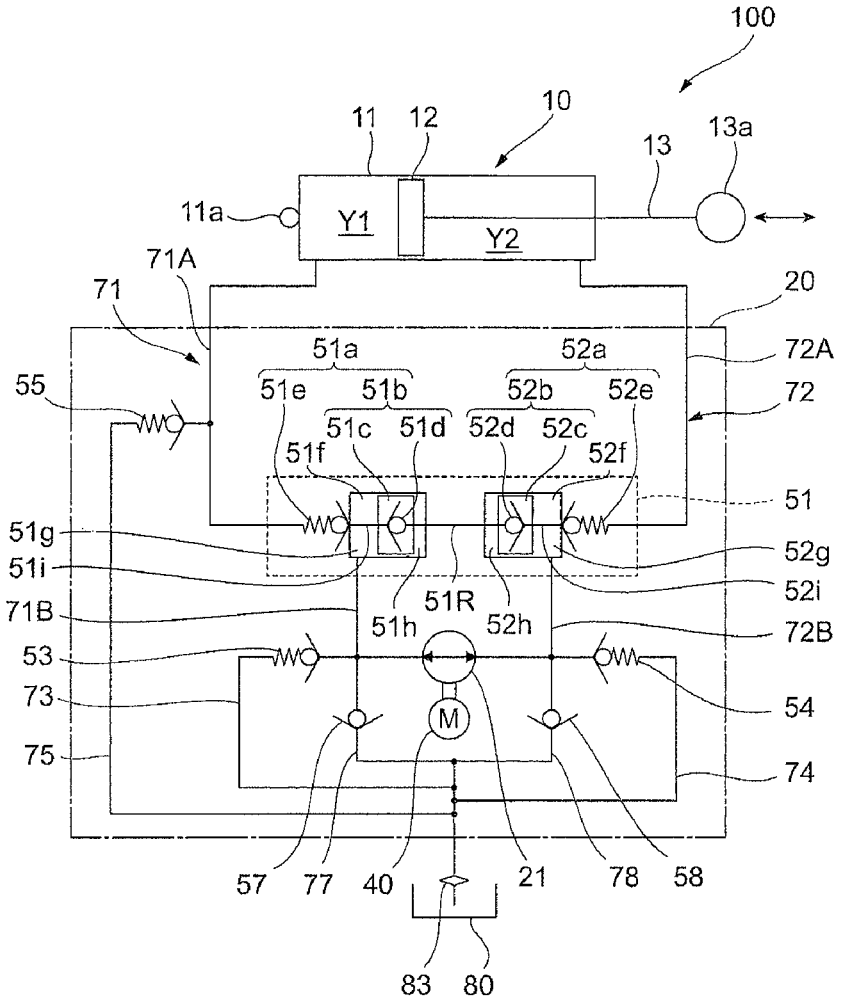
FIG. 5 is a view showing a hydraulic circuit of the trim tilt device.

FIG. 5 shows a hydraulic circuit of the trim tilt device 100. First, the hydraulic circuit of the trim tilt device 100 will be described with reference to FIG. 5.

The inside of the cylinder device 10 is segmented by the piston 12 into the first chamber Y1 and the second chamber Y2. The cylinder device 10 extends when oil is supplied to the first chamber Y1, and the cylinder device 10 compresses when oil is supplied to the second chamber Y2. Oil is discharged from the second chamber Y2 when the cylinder device 10 extends, and oil is discharged from the first chamber Y1 when the cylinder device 10 compresses.

The hydraulic circuit is a circuit that controls supply and discharge of oil to the first chamber Y1 and the second chamber Y2.

Between the gear pump 21 formed of a pair of gears provided to the pump device 20 and the cylinder device 10, a first chamber-side flow path 71 communicating with the first chamber Y1 and a second chamber-side flow path 72 communicating with the second chamber Y2 are formed. In the first chamber-side flow path 71 and the second chamber-side flow path 72, a switching valve 51 is arranged across the first chamber-side flow path 71 and the second chamber-side flow path 72.

(Switching Valve 51)

The switching valve 51 switches the direction of oil flow to the first chamber Y1 or the second chamber Y2. The switching valve 51 includes a first open valve 51*a* provided on the first chamber-side flow path 71 and a second open valve 52*a* provided on the second chamber-side flow path 72.

The first open valve 51*a* includes a first actuation valve 51*b* and a first non-return valve 51*e*. The first actuation valve 51*b* includes a spool 51*c* that slides within a first valve chamber 51*f* and an actuation valve ball 51*d* built in the spool 51*c*. The first valve chamber 51*f* is partitioned by the spool 51*c* into a main oil chamber 51*g* on a side communicating with the first non-return valve 51*e* and a sub oil chamber 51*h* on the opposite side. A pump-side and first chamber-side flow path 71B communicating with the first open valve 51*a* from the gear pump 21 in the first chamber-side flow path 71 is connected to the main oil chamber 51*g* of the first open valve 51*a*.

Figure 9:
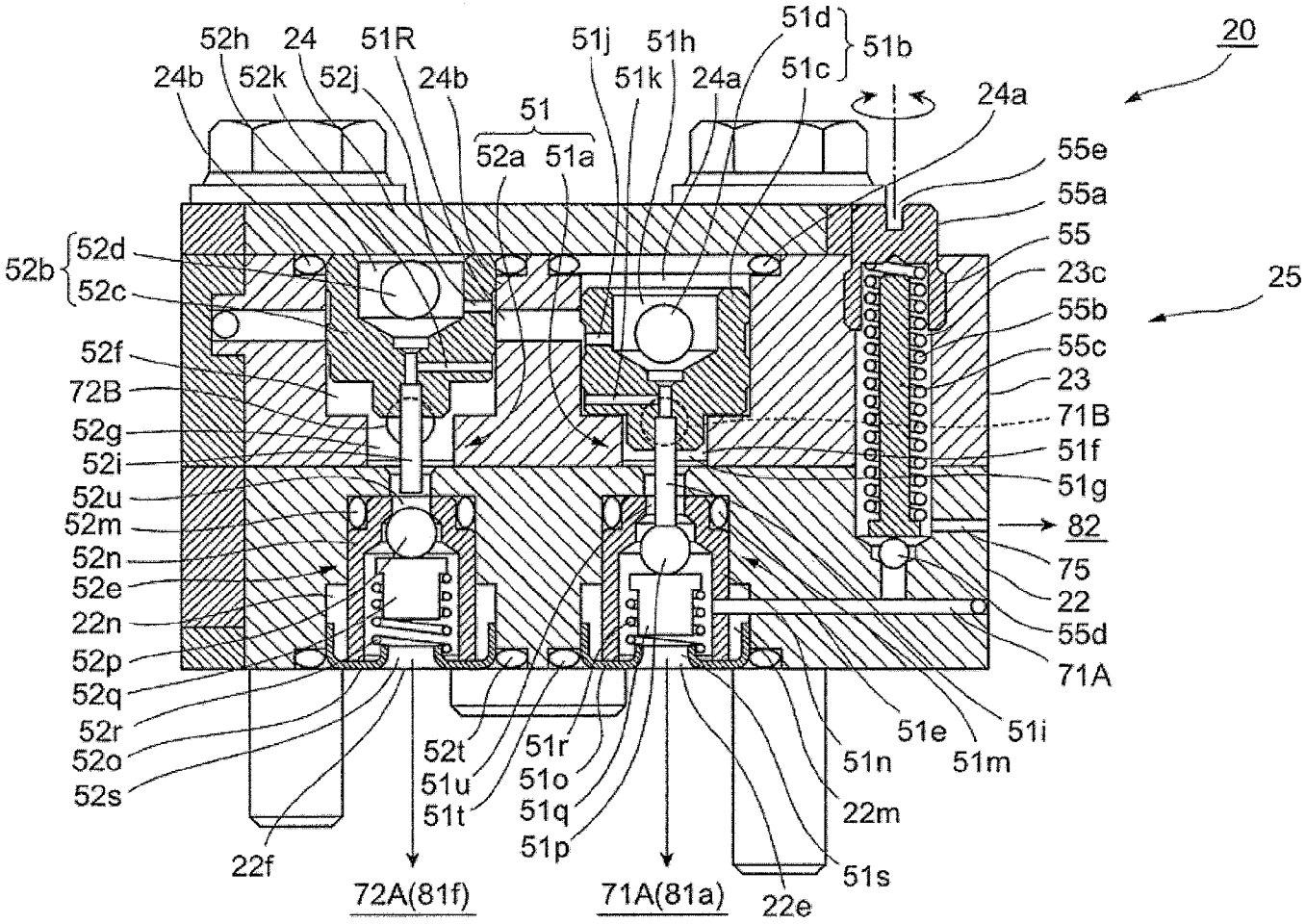
FIG. 9 is a sectional view at a plane including a first open valve and a second open valve of a switching valve and a third relief valve along line IX-IX in FIG. 6.

The spool 51*c* includes a protrusion 51*i* that protrudes toward the first non-return valve 51*e* and pushes the first non-return valve 51*e* upon displacement to the first non-return valve 51*e* side. As shown in FIG. 9 described below, the spool 51*c* is formed with a first hole 51*j* for communication of the main oil chamber 51*g* and the sub oil chamber 51*h* and a second hole 51*k* for communication of the sub oil chamber 51*h* and a communication path 51R described below.

The actuation valve ball 51*d* opens the first hole 51*j* when the pressure of the main oil chamber 51*g* is higher than the pressure of the sub oil chamber 51*h*, and closes the first hole 51*j* when the pressure of the main oil chamber 51*g* is lower than the pressure of the sub oil chamber 51*h*.

The second open valve 52*a* is similar in configuration to the first open valve 51*a*. That is, the second open valve 52*a* includes a second actuation valve 52*b* and a second non-return valve 52*e*. The second actuation valve 52*b* slides within a second valve chamber 52*f* and includes a spool 52*c* including a protrusion 52*i* that pushes a second non-return valve 52*e* and formed with a first hole 52*j* and a second hole 52*k* and an actuation valve ball 52*d* built in the spool 52*c* to open and close the first hole 52*j* in accordance with a high-low relationship of pressures of a main oil chamber 52*g* and a sub oil chamber 52*h*. The second valve chamber 52*f* is partitioned by the spool 52*c* into the main oil chamber 52*g* on a side communicating with the second non-return valve 52*e* and the sub oil chamber 52*h* on the opposite side. A pump-side and second chamber-side flow path 72B communicating with the second open valve 52*a* from the gear pump 21 in the second chamber-side flow path 72 is connected to the main oil chamber 52*g* of the second open valve 52*a*.

The sub oil chamber 51*h* of the first open valve 51*a* and the sub oil chamber 52*h* of the second open valve 52*a* are communicated by the communication path 51R.

For example, oil fed to the pump-side and first chamber-side flow path 71B from the gear pump 21 by a positive rotation of the gear pump 21 flows into the main oil chamber 51*g* of the first open valve 51*a*. The first non-return valve 51*e* is opened by an increase in pressure of the main oil chamber 51*g*. Oil flows from the first open valve 51*a* to the cylinder-side and first chamber-side flow path 71A communicating with the first chamber Y1 of the cylinder device 10 in the first chamber-side flow path 71, flows into the first chamber Y1 of the cylinder device 10, and pushes the piston 12 toward the second chamber Y2.

Oil that has flowed into the main oil chamber 51*g* of the first open valve 51*a* opens the actuation valve ball 51*d* within the spool 51*c* of the first actuation valve 51*b* and flows into the sub oil chamber 51*h*. Oil that has flowed into the sub oil chamber 51*h* reaches the sub oil chamber 52*h* of the second open valve 52*a* through the communication path 51R. Since the actuation valve ball 52*d* of the second actuation valve 52*b* is closed, oil in the sub oil chamber 52*h* presses the spool 52*c* to the main oil chamber 52*g* side.

The second non-return valve 52*e* is pushed and opened by the second actuation valve 52*b* moving to the main oil chamber 52*g* side, such that the pump-side and second chamber-side flow path 72B and the cylinder-side and second chamber-side flow path 72A communicating with the second chamber Y2 of the cylinder device 10 from the second open valve 52*a* are communicated in the second chamber-side flow path 72. Accordingly, oil in the second chamber Y2 on a side pushed by the piston 12 is discharged to the second chamber-side flow path 72 and returns to the gear pump 21 through the second chamber-side flow path 72.

The flow of oil fed to the pump-side and second chamber-side flow path 72B from the gear pump 21 by a negative rotation of the gear pump 21 is similar to the case of the positive rotation of the gear pump 21. That is, oil flows into the main oil chamber 52*g* of the second open valve 52*a*, opens the second non-return valve 52*e*, flows to the cylinder-side and second chamber-side flow path 72A, flows into the second chamber Y2 of the cylinder device 10, and pushes the piston 12 toward the first chamber Y1.

Oil that has flowed into the main oil chamber 52*g* of the second open valve 52*a* opens the actuation valve ball 52*d* within the spool 52*c* of the second actuation valve 52*b*, flows into the sub oil chamber 52*h*, reaches the sub oil chamber 51*h* of the first open valve 51*a* through the communication path 51R, and presses the spool 51*c* of the first actuation valve 51*b* to the main oil chamber 51*g* side. The pressed spool 51*c* pushes and opens the first non-return valve 51*e*, the cylinder-side and first chamber-side flow path 71A and the pump-side and first chamber-side flow path 71B are communicated, and oil in the first chamber Y1 on a side pushed by the piston 12 is discharged to the first chamber-side flow path 71 and returns to the gear pump 21 through the first chamber-side flow path 71.

In this manner, the first actuation valve 51*b* and the second actuation valve 52*b* have a function of being displaced under pressure of oil from the gear pump 21 to cause the second non-return valve 52*e* or the first non-return valve 51*e* to open in the displacement direction by the displacement.

The first non-return valve 51*e* and the second non-return valve 52*e* have a function of being opened by the displacement of the second actuation valve 52*b* or the first actuation valve 51*b* to return oil from the cylinder device 10 and a function of being opened by pressure that acts on the first valve chamber 51*f* or the second valve chamber 52*f* to supply oil to the cylinder device 10.

(Up Blow Valve 53)

The pump-side and first chamber-side flow path 71B is connected with an up blow valve 53 (first chamber-side relief valve). The up blow valve 53 is normally closed and opens when the pressure of the pump-side and first chamber-side flow path 71B has become greater than or equal to a pressure set in advance to relieve oil in the pump-side and first chamber-side flow path 71B to a first open flow path 73 communicating with the tank 80.

The following case is an example of a case where the pressure of the pump-side and first chamber-side flow path 71B becomes greater than or equal to a pressure set in advance. That is, such a case is when the rotation of the gear pump 21 does not stop even after the cylinder device 10 has extended to a maximum extension-compression range due to supply of oil to the first chamber Y1 of the cylinder device 10, such that oil continues to be supplied to the first chamber-side flow path 71. In this case, the up blow valve 53 opens to return oil supplied to the pump-side and first chamber-side flow path 71B to the tank 80 through the first open flow path 73.

(Down Blow Valve 54)

The pump-side and second chamber-side flow path 72B is connected with a down blow valve 54 (second chamber-side relief valve). The down blow valve 54 is normally closed and opens when the pressure of the pump-side and second chamber-side flow path 72B has become greater than or equal to a pressure set in advance to relieve oil in the pump-side and second chamber-side flow path 72B to a second open flow path 74 communicating with the tank 80.

The following case is an example of a case where the pressure of the pump-side and second chamber-side flow path 72B becomes greater than or equal to a pressure set in advance. That is, such a case is when the rotation of the gear pump 21 does not stop even after the cylinder device 10 has compressed to a minimum extension-compression range due to an increase in pressure of the second chamber-side flow path 72 corresponding to an increase in volume of the piston rod 13 entering the second chamber Y2 upon compression of the cylinder device 10 or supply of oil to the second chamber Y2 of the cylinder device 10, such that oil continues to be supplied to the second chamber-side flow path 72. In this case, the down blow valve 54 opens to return oil supplied to the pump-side and second chamber-side flow path 72B to the tank 80 through the second open flow path 74.

Upon compression and extension of the cylinder device 10, a large portion of oil in the first chamber Y1 and oil in the second chamber Y2 is merely circulating via the switching valve 51 and the gear pump 21. However, as described above, the total amount of oil in the first chamber Y1 and oil in the second chamber Y2 changes in accordance with the amount of entrance of the piston rod 13 to the second chamber Y2. Therefore, in the case where the amount of oil fed to the first chamber Y1 or the second chamber Y2 is insufficient, an amount of oil corresponding to the insufficiency is supplied to the gear pump 21 from the tank 80 through a first supply flow path 77 or a second supply flow path 78 respectively provided with check valves 57 and 58. Whether the flow path for supply of oil to the gear pump 21 from the tank 80 is the first supply flow path 77 or the second supply flow path 78 is determined in accordance with the rotating direction of the gear pump 21.

(Third Relief Valve 55)

The cylinder-side and first chamber-side flow path 71A is connected with a third relief valve 55 (third relief valve). The third relief valve 55 is normally closed and opens when the pressure of the cylinder-side and first chamber-side flow path 71A has become greater than or equal to a pressure set in advance (pressure higher than the pressure at which the up blow valve 53 is opened) to relieve oil in the cylinder-side and first chamber-side flow path 71A to a third open flow path 75 communicating with the tank 80.

The following case is an example of a case where the pressure of the cylinder-side and first chamber-side flow path 71A becomes greater than or equal to a pressure set in advance. That is, such a case is when load such as an impact is applied in a direction to compress the cylinder device 10 in a state where the cylinder device 10 is extended or when the pressure of the cylinder-side and first chamber-side flow path 71A has risen due to a rise in temperature of oil. In this case, the third relief valve 55 opens to return oil supplied to the cylinder-side and first chamber-side flow path 71A to the tank 80 via the third open flow path 75.

In the flow path communicating with the tank 80, a filter 83 is provided to prevent foreign matter or the like mixed in oil within the tank 80 from flowing into the respective flow paths described above.

<Pump Device 20>

Figure 6:
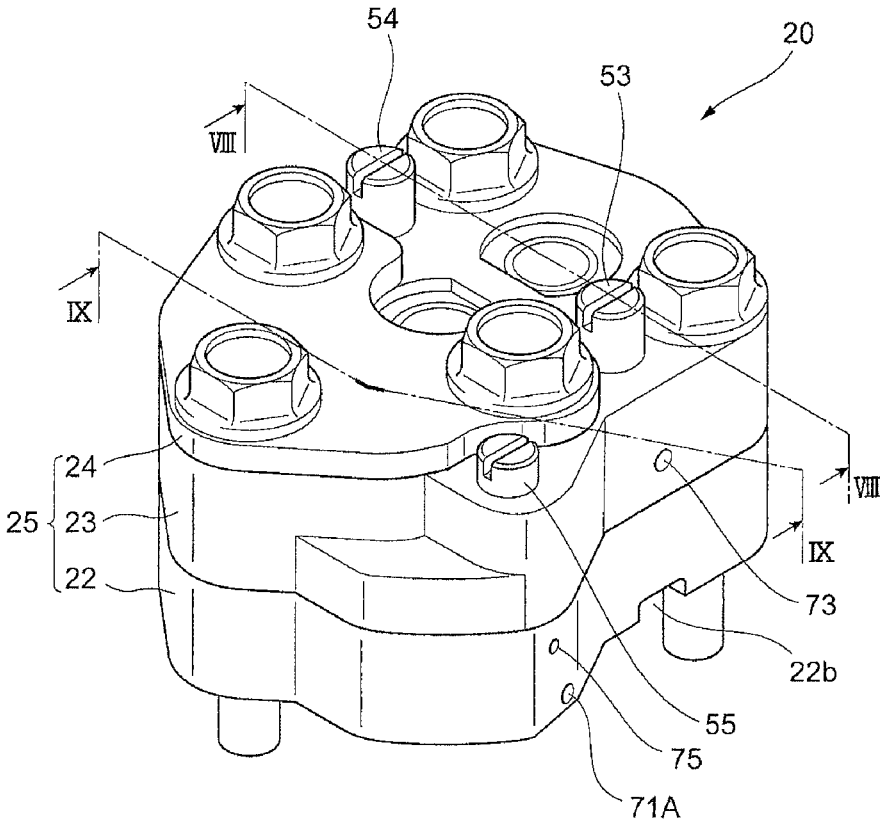
FIG. 6 is a view showing the external appearance of a pump device.
Figure 7:
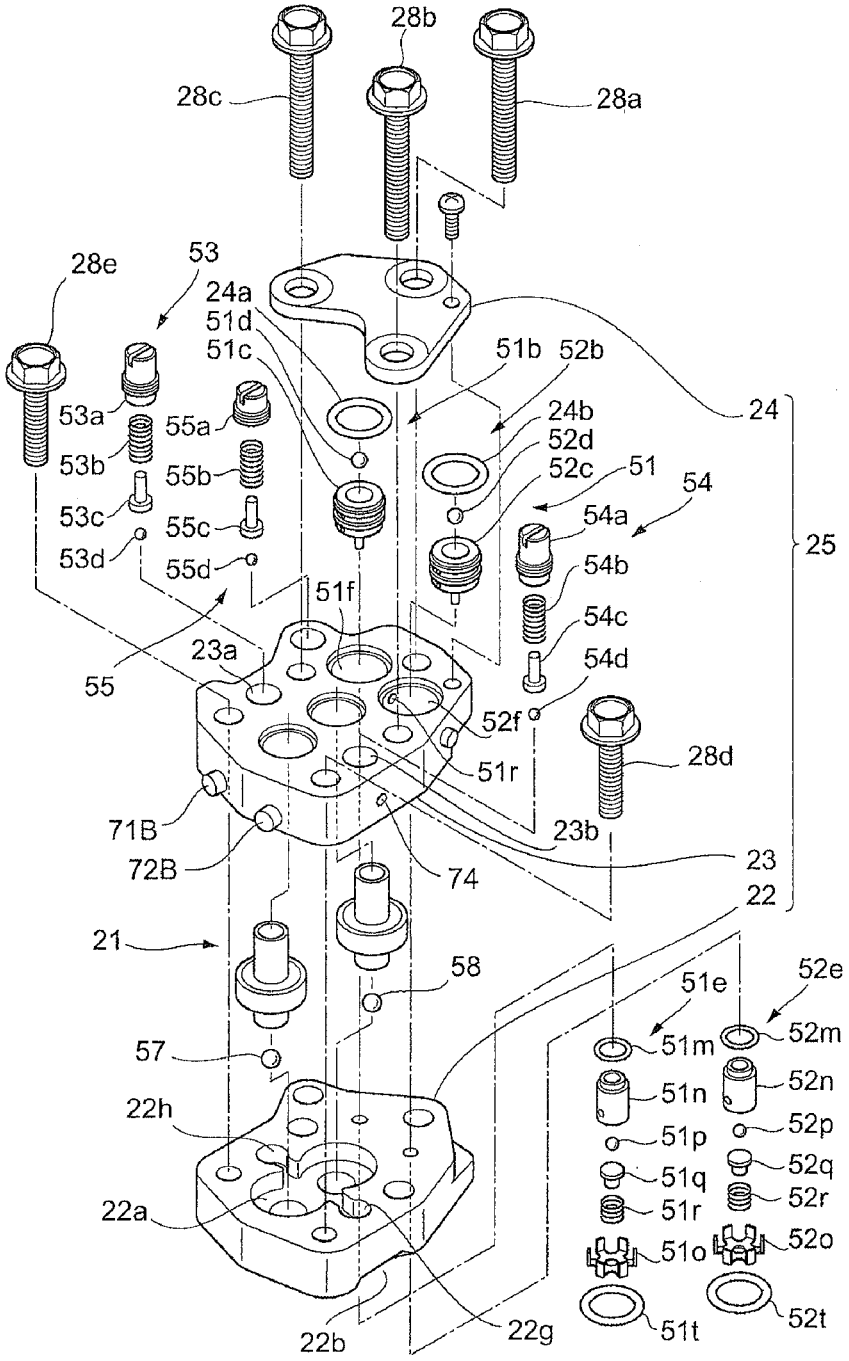
FIG. 7 is an exploded perspective view of the pump device broken down into components.
Figure 8:
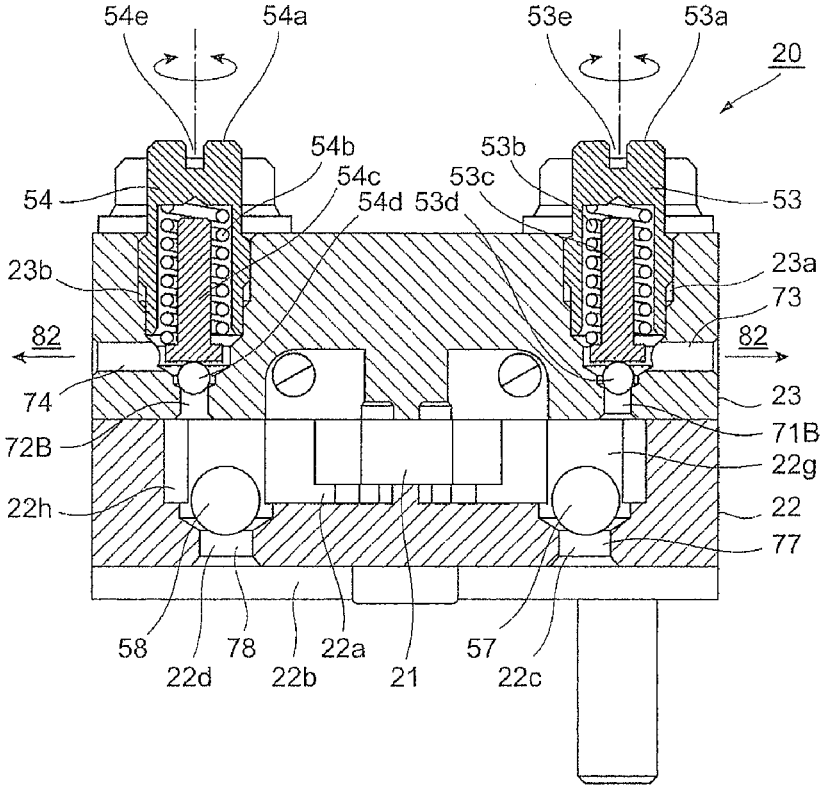
FIG. 8 is a sectional view at a plane including an up blow valve and a down blow valve along line VIII-VIII in FIG. 6.

FIG. 6 is a view showing the external appearance of the pump device 20. FIG. 7 is an exploded perspective view of the pump device 20 broken down into components. FIG. 8 is a sectional view at a plane including the up blow valve 53 and the down blow valve 54. FIG. 9 is a sectional view at a plane including the first open valve 51*a* and the second open valve 52*a* of the switching valve 51 and the third relief valve 55.

As shown in FIG. 7, the pump device 20 includes a pump case 25, the gear pump 21, the switching valve 51, the up blow valve 53, the down blow valve 54, the third relief valve 55, and the two check valves 57 and 58. The pump case 25 has a so-called three-body structure in which a first case 22, a second case 23, and a cover plate 24 (covering member) are stacked in this order from the bottom in the drawing and integrated by five fastening members 28*a*, 28*b*, 28*c*, 28*d*, and 28*e*. A part of five fastening members 28*a*, 28*b*, 28*c*, 28*d*, and 28*e* also serves a function of fixing the pump device 20 to the housing 81 (see FIG. 1).

The pump device 20 is configured integrally, as shown in FIG. 6, to accommodate the gear pump 21, the switching valve 51, the up blow valve 53, the down blow valve 54, the third relief valve 55, and the two check valves 57 and 58 inside the pump case 25.

The first case 22 is formed with a groove 22*b* at the bottom surface. The first case 22 is formed with a pump chamber 22*a* that accommodates the gear pump 21, check valve chambers 22*g* and 22*h* that accommodate the check valves 57 and 58, and a first non-return valve chamber 22*m* (see FIG. 9) and a second non-return valve chamber 22*n* that accommodate the first non-return valve 51*e* and the second non-return valve 52*e*.

The first non-return valve chamber 22*m* and the second non-return valve chamber 22*n* are each formed to penetrate in the direction of stacking the first case 22 and the second case 23.

The second case 23 is formed with the first valve chamber 51*f* and the second valve chamber 52*f*. The first valve chamber 51*f* and the second valve chamber 52*f* are each formed to also penetrate in the thickness direction of the second case 23. The second case 23 is formed with an up blow valve chamber 23*a* that accommodates the up blow valve 53, a down blow valve chamber 23*b* that accommodates the down blow valve 54, and a third relief valve chamber 23*c* that accommodates the third relief valve 55.

The cover plate 24 is, for example, an iron plate and closes an opening 23*x* (see FIG. 10 described below) of the first valve chamber 51*f* and the second valve chamber 52*f* formed in the second case 23.

As shown in FIG. 8, the gear pump 21 is arranged in the pump chamber 22*a*.

The up blow valve 53 and the down blow valve 54 are arranged respectively in the up blow valve chamber 23*a* and the down blow valve chamber 23*b*. The up blow valve 53 includes a valve ball 53*d* for opening and closing between the pump-side and first chamber-side flow path 71B continuous with the check valve chamber 22*g* and the first open flow path 73 continuous with the tank chamber 82, a push pin 53*c* that contacts the valve ball 53*d* from above, an adjustment screw 53*a* that is coaxial with the push pin 53*c* and screwed and joined to the up blow valve chamber 23*a* such that an upper section formed with a groove 53*e* for a tool protrudes upward from the second case 23, and a coil spring 53*b* arranged between the push pin 53*c* and the adjustment screw 53*a* to cause an elastic force in the axis direction in accordance with the distance between the push pin 53*c* and the adjustment screw 53*a* to act with respect to the push pin 53*c*.

With the up blow valve 53 configured in this manner, the screw depth of the adjustment screw 53*a* with respect to the second case 23 can be changed by inserting an easily available tool such as, for example, a slotted driver to the groove 53*e* of the adjustment screw 53*a* that protrudes outside the second case 23 and rotating the tool about the axis.

As the screw depth of the adjustment screw 53*a* increases, the distance between the push pin 53*c* and the adjustment screw 53*a* decreases, the initial compression amount of the coil spring 53*b* increases, the elastic force of the coil spring 53*b* to press the push pin 53*c* downward increases, and the load by which the valve ball 53*d* in contact with the push pin 53*c* closes the pump-side and first chamber-side flow path 71B increases. This means that the pressure of the pump-side and first chamber-side flow path 71B for transition to an operation of opening the closed up blow valve 53 has been set to be higher.

As the screw depth of the adjustment screw 53*a* decreases, the distance between the pushpin 53*c* and the adjustment screw 53*a* increases, the initial compression amount of the coil spring 53*b* decreases, the elastic force of the coil spring 53*b* to press the push pin 53*c* downward decreases, and the load by which the valve ball 53*d* in contact with the push pin 53*c* closes the pump-side and first chamber-side flow path 71B decreases. This means that the pressure of the pump-side and first chamber-side flow path 71B for transition to an operation of opening the closed up blow valve 53 has been set to be lower.

In this manner, the adjustment screw 53*a* of the up blow valve 53 is a pressure adjustment mechanism that adjusts the pressure (working pressure) for actuation (transition from a closed state to an open state) of the up blow valve 53.

In a similar manner to the up blow valve 53, the down blow valve 54 includes a valve ball 54*d* for opening and closing between the pump-side and second chamber-side flow path 72B continuous with the check valve chamber 22*h* and the second open flow path 74 continuous with the tank chamber 82, a push pin 54*c* that contacts the valve ball 54*d* from above, an adjustment screw 54*a* that is coaxial with the push pin 54*c* and screwed and joined to the down blow valve chamber 23*b* such that an upper section formed with a groove 54*e* for a tool protrudes upward from the second case 23, and a coil spring 54*b* arranged between the push pin 54*c* and the adjustment screw 54*a* to cause an elastic force in the axis direction in accordance with the distance between the push pin 54*c* and the adjustment screw 54*a* to act with respect to the push pin 54*c*. The adjustment screw 54*a* of the down blow valve 54 is also a pressure adjustment mechanism similar to the adjustment screw 53*a* of the up blow valve 53.

The adjusting action for the working pressure of the down blow valve 54 is the same as the adjusting action by the up blow valve 53, and therefore description is omitted.

The check valves 57 and 58 are respectively arranged in the check valve chambers 22*g* and 22*h* formed in the first case 22. The check valves 57 and 58 are arranged in the respective check valve chambers 22*g* and 22*h* in a step before the first case 22 and the second case 23 are stacked.

The check valve chambers 22*g* and 22*h* communicate with holes 22*c* and 22*d* that extend downward. The holes 22*c* and 22*d* are formed in such a size to be closed by the check valves 57 and 58 and are continuous with the groove 22*b* formed in the lower surface of the pump case 25. Since the pump device 20 is immersed in oil in the tank chamber 82, the groove 22*b* is filled with oil. The holes 22*c* and 22*d* correspond to the first supply flow path 77 and the second supply flow path 78 in the hydraulic circuit.

As shown in FIG. 9, the first actuation valve 51*b* and the second actuation valve 52*b* in the first open valve 51*a* and the second open valve 52*a* of the switching valve 51 are arranged in the first valve chamber 51*f* and the second valve chamber 52*f* formed in the second case 23. The first actuation valve 51*b* and the second actuation valve 52*b* are arranged respectively in the first valve chamber 51*f* and the second valve chamber 52*f* in a step before the second case 23 and the cover plate 24 are stacked.

By the cover plate 24 being stacked on and fixed to the second case 23 in a state where the first actuation valve 51*b* is arranged in the first valve chamber 51*f* and the second actuation valve 52*b* is arranged in the second valve chamber 52*f*, the upper surfaces of the first valve chamber 51*f* and the second valve chamber 52*f* are closed. At this time, O-rings 24*a* and 24*b* are attached respectively between the first valve chamber 51*f* and the cover plate 24 and between the second valve chamber 52*f* and the cover plate 24 to ensure liquid-tightness of the first valve chamber 51*f* and the second valve chamber 52*f*.

Since the first valve chamber 51*f* and the second valve chamber 52*f* are each formed to penetrate in the thickness direction of the second case 23, the accommodated first actuation valve 51*b* and second actuation valve 52*b* both slide along the direction of stacking the first case 22 and the second case 23.

The second case 23 is formed with the communication path 51R described with the hydraulic circuit to connect the sub oil chamber 51*h* of the first valve chamber 51*f* and the sub oil chamber 52*h* of the second valve chamber 52*f*.

The first non-return valve chamber 22*m* formed in the first case 22 is formed in a portion opposing the first valve chamber 51*f* in a state where the first case 22 and the second case 23 are stacked. The second non-return valve chamber 22*n* formed in the first case 22 is formed in a portion opposing the second valve chamber 52*f* in a state where the first case 22 and the second case 23 are stacked.

The first non-return valve 51*e* is configured to include an O-ring 51*m*, a valve case 51*n*, a valve ball 51*p*, a push pin 51*q*, a coil spring 51*r*, a spring holder 51*o*, and an O-ring 51*t*.

The valve case 51*n* is fitted to the first non-return valve chamber 22*m* with the O-ring 51*m* therebetween. At an upper section of the valve case 51*n*, a small hole 51*u* is formed for the protrusion 51*i* of the opposing first actuation valve 51*b* to be passed through. The valve ball 51*p*, the push pin 51*q*, and the coil spring 51*r* are arranged in a case inner chamber 51*s* formed on the inner side of the valve case 51*n*.

The valve ball 51*p* is formed in such a size to close the small hole 51*u* formed in the valve case 51*n*. The push pin 51*q* is arranged beneath the valve ball 51*p* such that the valve ball 51*p* contacts the upper surface. The spring holder 510 is fitted to a lower section of the first non-return valve chamber 22*m* to support the valve case 51*n* from below. The O-ring 51*t* is arranged around the spring holder 51*o*. The coil spring 51*r* is arranged between the push pin 51*q* and the spring holder 51*o* to cause an elastic force in the axis direction to act with respect to the push pin 51*q*.

In a state where the pump device 20 is fixed to the housing 81 as shown in FIG. 2, the case inner chamber 51*s* and the first housing hole 81*a* formed in the housing 81 are communicated by an opening 22*e* formed in a middle section of the spring holder 51*o*. At this time, liquid-tightness between the case inner chamber 51*s* as well as the first housing hole 81*a* and the tank chamber 82 is ensured by the O-ring 51*t*.

In the first non-return valve 51*e* configured in this manner, the pushpin 51*q* held upward by the elastic force of the coil spring 51*r* pushes the valve ball 51*p* upward such that the valve ball 51*p* closes the small hole 51*u* of the valve case 51*n*. Accordingly, it is closed between the main oil chamber 51*g* of the first actuation valve 51*b* and the case inner chamber 51*s* of the first non-return valve 51*e*.

When oil is supplied to the main oil chamber 51*g* of the first actuation valve 51*b* and the pressure of the main oil chamber 51*g* rises, the pressure of the main oil chamber 51*g* acts on the valve ball 51*p* through the small hole 51*u*, the valve ball 51*p* is pushed downward against the elastic force of the coil spring 51*r*, the main oil chamber 51*g* and the case inner chamber 51*s* are communicated, and oil in the main oil chamber 51*g* is supplied to the first housing hole 81*a* through the case inner chamber 51*s*.

When oil is supplied to the main oil chamber 52*g* of the second actuation valve 52*b* and the pressure of the main oil chamber 52*g* rises, oil in the main oil chamber 52*g* flows through the second hole 52*k* of the spool 52*c* to the sub oil chamber 52*h*, the first hole 52*j*, and the communication path 51R in that order and further flows into the sub oil chamber 51*h* of the first actuation valve 51*b* through the first hole 51*j* of the first actuation valve 51*b*.

In the sub oil chamber 51*h* of the first actuation valve 51*b*, a rise in pressure causes the actuation valve ball 51*d* to block communication of the sub oil chamber 51*h* and the main oil chamber 51*g*. Accordingly, the spool 51*c* of the first actuation valve 51*b* moves to the main oil chamber 51*g* side. Due to the movement of the spool 51*c*, the protrusion 51*i* provided to the spool 51*c* acts on the valve ball 51*p* for a push downward against the elastic force of the coil spring 51*r*, the main oil chamber 51*g* and the case inner chamber 51*s* are communicated, and oil returned to the case inner chamber 51*s* from the first housing hole 81*a* is returned to the main oil chamber 51*g*.

The second non-return valve 52*e* accommodated in the second non-return valve chamber 22*n* is similar in configuration to the first non-return valve 51*e* and includes an O-ring 52*m*, a valve case 52*n*, a valve ball 52*p*, a pushpin 52*q*, a coil spring 52*r*, a spring holder 52*o*, and an O-ring 52*t*. The second non-return valve 52*e* acts in the same manner as the first non-return valve 51*e*, and therefore description is omitted.

In a state where the pump device 20 is fixed to the housing 81 (see FIG. 2), a case inner chamber 52*s* and the fourth housing hole 81*f* formed in the housing 81 are communicated by an opening 22*f* formed in a middle section of the spring holder 52*o*. At this time, liquid-tightness between the case inner chamber 52*s* as well as the fourth housing hole 81*f* and the tank chamber 82 is ensured by the O-ring 52*t*.

The third relief valve 55 is arranged across the first case 22 and the second case 23. In a similar manner to the up blow valve 53 and the down blow valve 54, the third relief valve 55 includes a valve ball 55*d* for opening and closing between the cylinder-side and first chamber-side flow path 71A communicating with the case inner chamber 51*s* of the first non-return valve 51*e* and the third open flow path 75, a push pin 55*c* that contacts the valve ball 55*d* from above, an adjustment screw 55*a* that is coaxial with the push pin 55*c* and screwed and joined to the second case 23 such that an upper section formed with a thread groove 55*e* protrudes upward from the second case 23, and a coil spring 55*b* arranged between the push pin 55*c* and the adjustment screw 55*a* to cause an elastic force in the axis direction in accordance with the distance between the push pin 55*c* and the adjustment screw 55*a* to act with respect to the push pin 55*c*. The adjustment screw 55*a* of the third relief valve 55 is also a pressure adjustment mechanism similar to the adjustment screw 53*a* of the up blow valve 53.

The adjusting action for the working pressure of the third relief valve 55 is the same as the adjusting action by the up blow valve 53 or the down blow valve 54, and therefore description is omitted.

<Action and Effect of Pump Device 20>

With the pump device 20 of this embodiment configured in a manner described above, the switching valve 51, the up blow valve 53, the dawn blow valve 54, the third relief valve 55, and the check valves 57 and 58 included in the hydraulic circuit connected to the cylinder device 10 are provided integrally with the pump device 20. Therefore, the performance of the entire hydraulic circuit built in with the switching valve 51, the up blow valve 53, the down blow valve 54, the third relief valve 55, and the check valves 57 and 58 can be measured in a step of measuring the performance such as the oil pressure-feed capability of the gear pump 21 in a state where the pump device 20 is alone before being assembled with the cylinder device 10.

Accordingly, in a step when the pump device 20 is alone before being assembled to the housing 81, a performance measurement for the gear pump 21 and a performance measurement for the entire hydraulic circuit can be performed together in the pump device 20 of this embodiment.

Thus, work of performance measurement conventionally performed in two separate steps of measuring the performance of only the gear pump of the pump device alone and then assembling the pump device to the housing built in with multiple valves forming the hydraulic circuit to measure the performance of the entire hydraulic circuit after the assembly can be integrated into work of one step with the trim tilt device 100.

Accordingly, with the trim tilt device 100 including the pump device 20 of this embodiment, the number of steps for a performance measurement of the pump device 20 and the hydraulic circuit can be reduced.

Moreover, since the pump case 25 of the pump device 20 employs a three-body structure that can be divided into three members (the first case 22, the second case 23, and the cover plate 24), the valves (the switching valve 51, the up blow valve 53, the down blow valve 54, the third relief valve 55, and the check valves 57 and 58) described above can be arranged inside the pump case 25 in a state of being disassembled into the three members. Thus, the layout for arranging the valves (the switching valve 51, the up blow valve 53, the down blow valve 54, the third relief valve 55, and the check valves 57 and 58) in the pump case 25 can be simplified.

Particularly, since the actuating direction of the switching valve 51, the up blow valve 53, the down blow valve 54, the third relief valve 55, and the check valves 57 and 58 is along the stacking direction of the first case 22, the second case 23, and the cover plate 24, the flow path (for example, the first open flow path 73, the second open flow path 74, and the third open flow path 75) in the hydraulic circuit that connects the valves can be formed to extend in a direction (for example, direction orthogonal to the stacking direction as shown in FIGS. 8 and 9) that intersects with the stacking direction.

Thus, the flow paths can also be formed in a simple linear shape instead of a complicated intersecting shape.

Due to the switching valve 51, the up blow valve 53, the down blow valve 54, the third relief valve 55, and the check valves 57 and 58 in the hydraulic circuit connected to the cylinder device 10 being provided integrally with the pump device 20, a valve of the hydraulic circuit is not arranged in the housing 81. That is, in the housing 81, as shown in FIG. 3, only the flow path (a part of the cylinder-side and first chamber-side flow path 71A and a part of the cylinder-side and second chamber-side flow path 72A) connecting the pump device 20 and the first chamber Y1 as well as the second chamber Y2 of the cylinder device 10 is formed.

Specifically, as shown in FIG. 3, only the first housing hole 81*a*, the second housing hole 81*b*, and the third housing hole 81*c* forming a part of the cylinder-side and first chamber-side flow path 71A are formed.

Thus, in the housing 81 of this embodiment, the flow path (the cylinder-side and first chamber-side flow path 71A and the cylinder-side and second chamber-side flow path 72A) to be formed can be simplified, compared to a housing of a conventional hydraulic actuator in which a valve is arranged. As a result, portions connected by intersection of holes that are flow paths can be reduced in the flow path (the cylinder-side and first chamber-side flow path 71A and the cylinder-side and second chamber-side flow path 72A) formed in the housing 81.

In the portion where the holes intersect, there is a tendency that a burr generated upon boring and working the hole easily remains. By reducing portions where the holes intersect, a burr can be made less likely to remain in the flow path.

Since the up blow valve 53, the down blow valve 54, the third relief valve 55 of the pump device 20 of this embodiment respectively include the adjustment screws 53*a*, 54*a*, and 55*a* that protrude outside the pump case 25, the adjustment screws 53*a*, 54*a*, and 55*a* can be rotated to adjust the respective working pressures of the up blow valve 53, the down blow valve 54, and the third relief valve 55 upon measuring the performance of the entire hydraulic circuit in a state where the pump device 20 is assembled.

There are individual differences caused during the manufacture of each of the gear pump 21 forming the pump device 20 and the respective flow paths as well as the up blow valve 53, the down blow valve 54, and the third relief valve 55 in the hydraulic circuit. The individual differences of the components, even if small on a component-by-component basis, may become a large individual difference when a plurality of the components are combined.

In the trim tilt device 100 of this embodiment as well, the respective working pressures of the up blow valve 53, the down blow valve 54, and the third relief valve 55 within the entire hydraulic circuit may become biased toward the upper limit side or biased to the lower limit side of an acceptable range due to accumulation of the individual difference for each component described above.

The trim tilt device 100 of this embodiment is in such a state where approximately all of the gear pump 21, the valves, and the flow paths forming the hydraulic circuit are built integrally in the pump device 20 and the individual differences are accumulated in the entire hydraulic circuit. By adjusting the respective working pressures of the up blow valve 53, the down blow valve 54, and the third relief valve 55 respectively with the adjustment screws 53*a*, 54*a*, and 55*a* in the pump device 20 in a state where the individual differences have accumulated, the respective working pressures of the up blow valve 53, the down blow valve 54, the third relief valve 55 in the entire hydraulic circuit can be adjusted with high precision, and variation can be reduced.

Since the respective working pressures of the up blow valve 53, the down blow valve 54, and the third relief valve 55 in the entire hydraulic circuit are adjusted in a state where the pump device 20 is alone in this manner for the pump device 20 and the trim tilt device 100 of this embodiment, replacement or the like of the up blow valve 53, the down blow valve 54, and the third relief valve 55 is not necessary, and the first pass yield in a manufacturing step can be improved.

Conventionally, a pump device in which a relief valve out of valves of a hydraulic control circuit is integrated with a pump is connected to a pressure-controlled oil path for performance measurement that is different from an actual valve and flow path in a hydraulic actuator to temporarily construct an entire hydraulic circuit and perform measurement of the performance of the entire hydraulic circuit in this temporary state. Since the pressure-controlled oil path for performance measurement is different from the actual valve and flow path in the hydraulic actuator in this case, there is a difference in the flow path resistance or the like, and a performance measurement with high precision cannot be performed.

In contrast, with the pump device 20 and the trim tilt device 100 of this embodiment, a performance measurement can be performed with the actual hydraulic circuit in the trim tilt device 100, and therefore a performance measurement with high precision can be performed.

The pump device 20 and the trim tilt device 100 of this embodiment are not limited those in which the respective relief valves (the up blow valve 53, the down blow valve 54, and the third relief valve 55) include the pressure adjustment mechanism (the adjustment screw 53*a* in the up blow valve 53, the adjustment screw 54*a* in the down blow valve 54, and the adjustment screw 55*a* in the third relief valve 55). Even with a configuration in which the respective relief valves do not include the pressure adjustment mechanism, the effect of the present invention with a configuration in which the switching valve 51, the up blow valve 53, the down blow valve 54, the third relief valve 55, and the check valves 57 and 58 are provided integrally with the pump device 20 can be exhibited.

Embodiment 2

In the pump device 20 and the trim tilt device 100 of the embodiment described above, two relief valves that are the up blow valve 53 and the third relief valve 55 are provided in the first chamber-side flow path 71 communicating with the first chamber Y1 of the cylinder device 10, as shown in FIG. 5. However, the pump device and the hydraulic actuator according to the present invention are not limited to this form.

Figure 10:
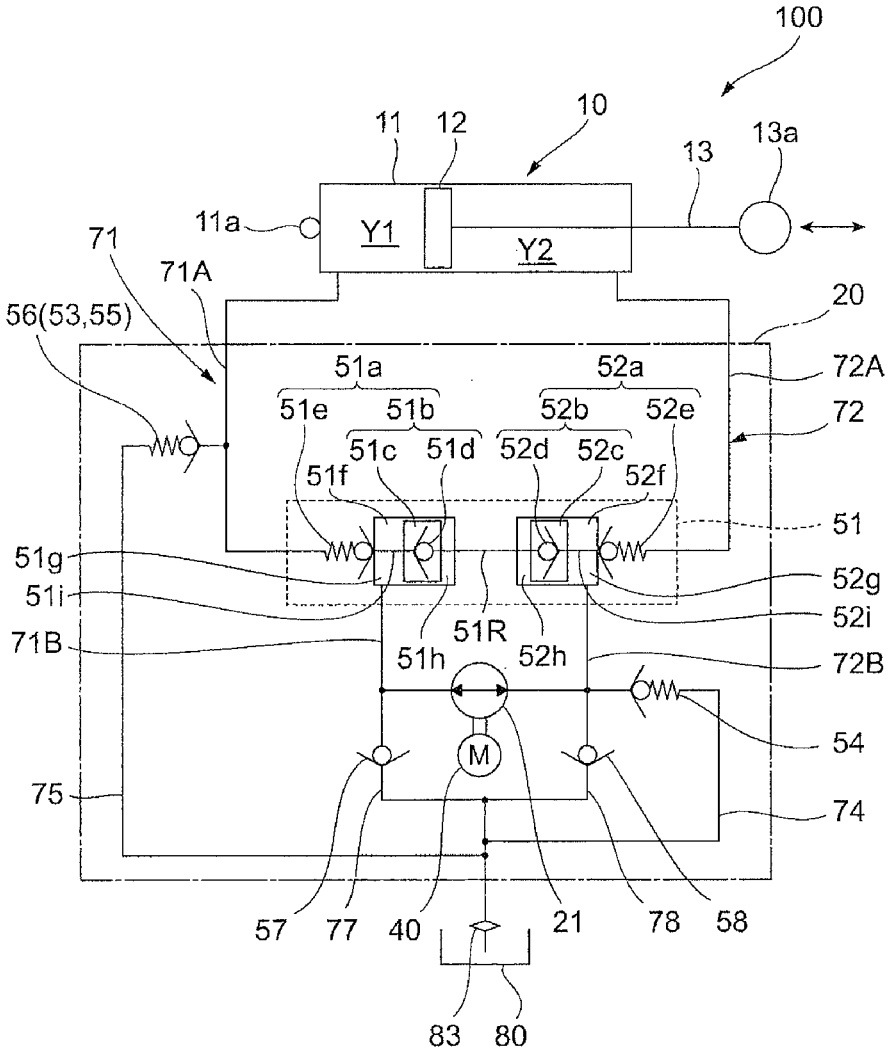
FIG. 10 is a view showing a hydraulic circuit of a trim tilt device in Embodiment 2.

FIG. 10 is a view showing a hydraulic circuit of the pump device 20 in a second embodiment (Embodiment 2) of the present invention.

In the hydraulic circuit of the pump device 20 shown in FIG. 10, the up blow valve 53 and the first open flow path 73 are not provided to the pump-side and first chamber-side flow path 71B, unlike in the hydraulic circuit in Embodiment 1 (see FIG. 5). The cylinder-side and first chamber-side flow path 71A is provided with a first chamber-side flow path relief valve 56 (first chamber-side relief valve) including a function of the up blow valve 53 and the third open flow path 75 that relieves the pressure of the cylinder-side and first chamber-side flow path 71A when the first chamber-side flow path relief valve 56 has been opened.

The first chamber-side flow path relief valve 56 is connected to the cylinder-side and first chamber-side flow path 71A in the same manner as the third relief valve 55 in Embodiment 1. Thus, the first chamber-side flow path relief valve 56 doubles as the up blow valve 53 and the third relief valve 55 in Embodiment 1.

That is, for a function of the up blow valve 53, the first chamber-side flow path relief valve 56 is normally closed and opens when the pressure of the pump-side and first chamber-side flow path 713, i.e., the first chamber-side flow path 71, has become greater than or equal to a pressure set in advance to relieve oil in the first chamber-side flow path 71 to the third open flow path 75 communicating with the tank 80. That is, in the case where the rotation of the gear pump 21 does not stop even after the cylinder device 10 has extended to a maximum extension-compression range due to supply of oil to the first chamber Y1 of the cylinder device 10, the first chamber Y1 is protected in a case where the oil is supplied continuously to the first chamber-side flow path 71.

In a similar manner to the third relief valve 55, the first chamber-side flow path relief valve 56 is normally closed and opens when the pressure of the cylinder-side and first chamber-side flow path 71A has become greater than or equal to a pressure set in advance to relieve oil in the cylinder-side and first chamber-side flow path 71A to the third open flow path 75 communicating with the tank 80. That is, in the case where load such as an impact is applied in a direction to compress the cylinder device 10 in a state where the cylinder device 10 is extended or when the temperature of oil has risen, the first chamber Y1 is protected.

In a similar manner to the up blow valve 53 and the third relief valve 55 in Embodiment 1, the first chamber-side flow path relief valve 56 includes a pressure adjustment mechanism (corresponding to the adjustment screw 53*a* in the up blow valve 53 and the adjustment screw 55*a* in the third relief valve 55). With the pressure adjustment mechanism, the setting pressure for the up blow valve 53 is set upon performance measurement or the like in a state where the hydraulic circuit is connected.

The up blow valve 53 and the third relief valve 55 in Embodiment 1 differ in the situation for actuation. That is, the up blow valve 53 deals with a rise in pressure from the gear pump 21 side, and the third relief valve 55 mainly deals with a rise in pressure from the cylinder device 10 side. Thus, the up blow valve 53 and the third relief valve 55 are set with pressures for actuation in a pressure range suitable for respective situations, and therefore are provided separately and independently.

As described in Embodiment 1, the third relief valve 55 is set to be actuated in the pressure range higher than the pressure range in which the up blow valve 53 is actuated. This is because the third relief valve 55 is arranged on the downstream of the switching valve 51 in the first chamber-side flow path 71. If the switching valve 51 does not intervene, the pressure range for actuation may be the same as the pressure range in which the up blow valve 53 is actuated.

In the pump device 20 and the trim tilt device 100 of Embodiment 2, the number of components and the number of working steps are reduced and the manufacturing cost is reduced, compared to the pump device 20 and the trim tilt device 100 of Embodiment 1, by integrating the two relief valves (the up blow valve 53 and the third relief valve 55) in the cylinder-side and first chamber-side flow path 71A.

The pump device 20 and the trim tilt device 100 of Embodiment 2 obviously exhibits the effect exhibited by the pump device 20 and the trim tilt device 100 of Embodiment 1.

The pump device 20 and the trim tilt device 100 of Embodiment 2 are also not limited to those in which the two relief valves (the first chamber-side flow path relief valve 56 and the down blow valve 54) include the pressure adjustment mechanism.

Note that at least the first chamber-side flow path relief valve 56 that doubles as the up blow valve 53 and the third relief valve 55 in function preferably includes the pressure adjustment mechanism in order to increase the precision of pressure for actuation.

Embodiment 3

In the pump device 20 and the trim tilt device 100 of Embodiment 1 described above, the third relief valve 55 is provided in the first chamber-side flow path 71 communicating with the first chamber Y1 of the cylinder device 10, as shown in FIG. 5. However, the pump device and the hydraulic actuator according to the present invention are not limited to this form.

Figure 11:
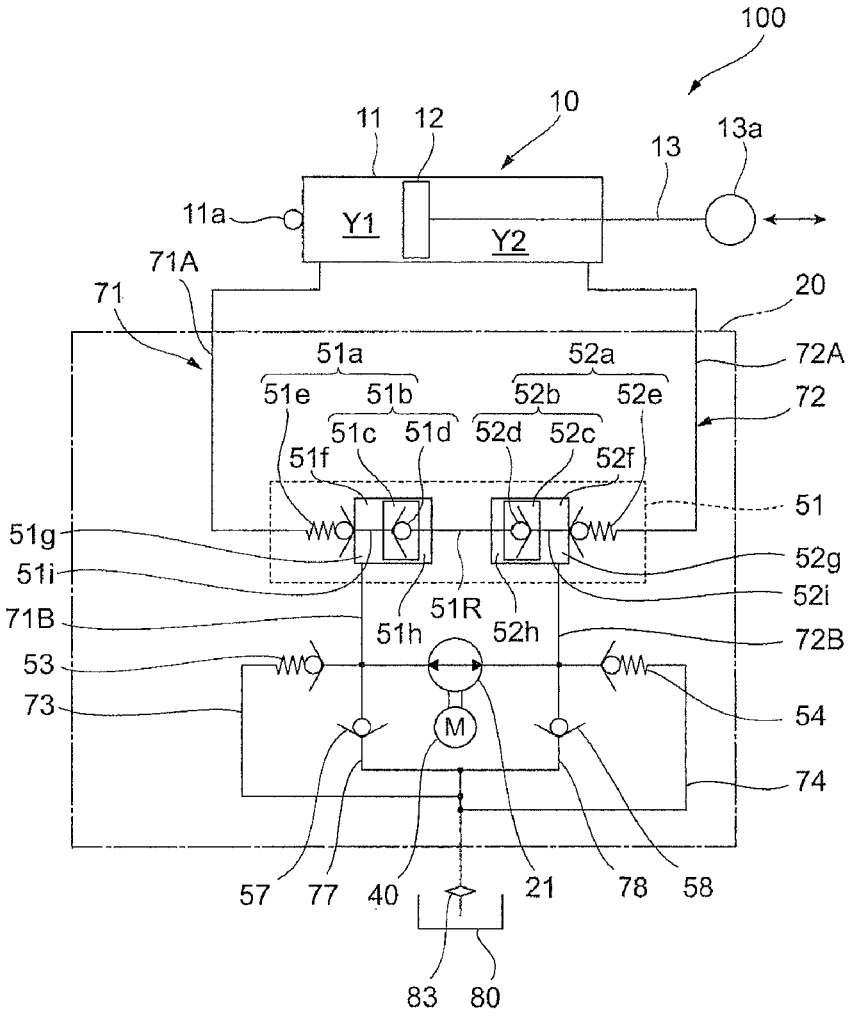
FIG. 11 is a view showing a hydraulic circuit of a trim tilt device in Embodiment 3.

FIG. 11 is a view showing a hydraulic circuit of the pump device 20 in a third embodiment (Embodiment 3) of the present invention.

The configuration of the hydraulic circuit of the pump device 20 shown in FIG. 11 is the same as in Embodiment 1, except that the third relief valve 55 and the third open flow path 75 connected to the cylinder-side and first chamber-side flow path 71A are not provided, unlike in the hydraulic circuit of Embodiment 1 (see FIG. 5).

Thus, with the pump device 20 and the trim tilt device 100 of Embodiment 3, the same effect as with the pump device 20 and the trim tilt device 100 of Embodiment 1 can be obtained, except for the action and effect exhibited by the third relief valve 55.

The pump device 20 and the trim tilt device 100 of Embodiment 3 are also not limited to those in which the respective relief valves (the up blow valve 53 and the down blow valve 54) include the pressure adjustment mechanism. Even with a configuration in which the respective relief valves do not include the pressure adjustment mechanism, the effect of the present invention with a configuration in which the switching valve 51, the up blow valve 53, the down blow valve 54, and the check valves 57 and 58 are provided integrally with the pump device 20 can be exhibited.

In the respective embodiments described above, the trim tilt device is applied as one example of the hydraulic actuator. However, the hydraulic actuator of the present invention is not limited to such trim tilt devices.

10: Cylinder device, 12: Piston, 20: Pump device, 51: Switching valve, 53: Up blow valve (first chamber-side relief valve), 54: Down blow valve (second chamber-side relief valve), 71: First chamber-side flow path, 72: Second chamber-side flow path, 100: Trim tilt device (hydraulic actuator), Y1: First chamber, Y2: Second chamber

What is claimed is:

1. A pump device comprising:

a pump case;

a switching valve for switching a flow of hydraulic fluid to one of a first chamber and a second chamber of a cylinder device, an inside of which is segmented into the first chamber and the second chamber by a piston;

a first chamber-side relief valve that is capable of relieving pressure of a first chamber-side flow path connected to the first chamber; and a second chamber-side relief valve that is capable of relieving pressure of a second chamber-side flow path connected to the second chamber, wherein the switching valve, the first chamber-side relief valve, and the second chamber-side relief valve are integrally accommodated inside the pump case, and the first chamber-side relieve valve and the second chamber-side relief valve comprise a pressure adjustment mechanism that adjusts a working pressure.

2. The pump device according to claim 1, wherein the first chamber-side relief valve is provided in a flow path between the switching valve and the first chamber.

3. The pump device according to claim 1, wherein the first chamber-side relief valve is provided in a flow path between the switching valve and the first chamber.

4. The pump device according to claim 1, wherein the pump device further comprises a pump for feeding the hydraulic fluid, the first chamber-side relief valve and the second chamber-side relief valve are provided in a flow path between the switching valve and the pump for feeding the hydraulic fluid, and the pump device further comprises a third relief valve including a pressure adjustment mechanism that adjusts a working pressure in a flow path between the first chamber and the switching valve.

5. The pump device according to claim 1, wherein the pump device further comprises a pump for feeding the hydraulic fluid, the first chamber-side relief valve and the second chamber-side relief valve are provided in a flow path between the switching valve and the pump for feeding the hydraulic fluid, and the pump device further comprises a third relief valve including a pressure adjustment mechanism that adjusts a working pressure in a flow path between the first chamber and the switching valve.

6. The pump device according to claim 1, wherein the cylinder device is provided outside of the pump case.

7. The pump device according to claim 1, wherein the pump case is composed of a first case, a second case, and a cover plate, which are stacked in this order from a bottom of the pump device.

8. A hydraulic actuator comprising:

a cylinder device, an inside of which is segmented into a first chamber and a second chamber by a piston; and a pump device comprising:

a pump case;

a switching valve for switching a flow of hydraulic fluid to one of the first chamber and the second chamber;

a first chamber-side relief valve that relieves pressure of a first chamber-side flow path connected to the first chamber; and a second chamber-side relief valve that relieves pressure of a second chamber-side flow path connected to the second chamber, wherein the switching valve, the first chamber-side relief valve, and the second chamber-side relief valve are integrally accommodated inside the pump case.

* * * * *